US011835193B2

(12) United States Patent
Hashiba et al.

(10) Patent No.: US 11,835,193 B2
(45) Date of Patent: Dec. 5, 2023

(54) LIGHTING TOOL FOR VEHICLE

(71) Applicant: STANLEY ELECTRIC CO., LTD., Tokyo (JP)

(72) Inventors: Kazunori Hashiba, Tokyo (JP); Yasuhiro Nakamura, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 18/131,716

(22) Filed: Apr. 6, 2023

(65) Prior Publication Data

US 2023/0324021 A1 Oct. 12, 2023

(30) Foreign Application Priority Data

Apr. 11, 2022 (JP) ..... 2022-065040

(51) Int. Cl.
*F21V 8/00* (2006.01)
*F21S 41/24* (2018.01)

(52) U.S. Cl.
CPC ..... *F21S 41/24* (2018.01)

(58) Field of Classification Search
CPC ..... B60Q 1/0011; F21S 41/24; F21S 43/236; F21S 43/249; F21S 43/245; F21S 43/315; F21S 43/14; G02B 6/0018; G02B 6/0021; G02B 6/0028; G02B 6/0031; G02B 6/0073; G02B 6/002; G02B 6/0036; G02B 6/0046; F21V 2200/20; F21Y 2103/10; F21Y 2113/13; F21Y 2115/10
See application file for complete search history.

(56) References Cited

U.S. PATENT DOCUMENTS 10,775,013 B2 * 9/2020 O ..... F21S 43/239
2011/0292670 A1 12/2011 Hara
2019/0023176 A1 * 1/2019 Ishizaka ..... B60Q 1/2696
2019/0351814 A1 * 11/2019 Furubayashi ..... B60Q 1/0011
(Continued)

FOREIGN PATENT DOCUMENTS

EP 0380663 A1 8/1990
EP 1176360 A2 1/2002
(Continued)

OTHER PUBLICATIONS

Extended European Search Report for the related European Patent Application No. 23166065.5 dated Jul. 26, 2023.

*Primary Examiner* — Elmito Breval
(74) *Attorney, Agent, or Firm* — KENEALY VAIDYA LLP

(57) ABSTRACT

A lighting tool for a vehicle includes light source and light guide body that guides light emitted from the light source, and the light guide body has first light guide portion disposed in front of the light source, second light guide portion that is branched off from the first light guide portion and that extends so as to go around toward a side of the light source, incidence portion that is located on a back surface side of the first light guide portion and that is configured to cause the light emitted from the light source to enter the inside of the first light guide portion, and side emitting portion that is located on a side of the first light guide portion facing the second light guide portion and that is configured to emit some of the light entered from the incidence portion toward the second light guide portion.

12 Claims, 13 Drawing Sheets

(56) References Cited

U.S. PATENT DOCUMENTS

| | | | | |
|---|---|---|---|---|
| 2022/0154908 | A1* | 5/2022 | Shinohara | F21S 43/26 |
| 2022/0397252 | A1* | 12/2022 | Kikuchi | F21S 43/241 |

FOREIGN PATENT DOCUMENTS

| | | | |
|---|---|---|---|
| EP | 1826475 | A1 | 8/2007 |
| JP | 2012-028156 | A | 2/2012 |
| JP | 2017021892 | A | 1/2017 |
| JP | 2018120683 | A | 8/2018 |

* cited by examiner

LIGHTING TOOL FOR VEHICLE

CROSS-REFERENCE TO RELATED APPLICATION

Priority is claimed on Japanese Patent Application No. 2022-065040, filed Apr. 11, 2022, the content of which is incorporated herein by reference.

BACKGROUND OF THE INVENTION

Field of the Invention

The present invention relates to a lighting tool for a vehicle.

Description of Related Art

In the related art, as a lighting tool for a vehicle mounted on a vehicle, a configuration in which a light source such as a light emitting diode (LED) or the like and a light guide body such as an inner lens or the like are combined is known.

In such a lighting tool for a vehicle, light emitted from the light source enters from a base end side of the light guide body, and the light is guided toward a tip side of the light guide body while repeating reflection of the light in the light guide body. In addition, the light reflected by a plurality of reflection cuts provided on a back surface side of the light guide body is emitted from a front surface side of the light guide body. Accordingly, it is possible to emit light from a light emitting surface provided on a front surface side of the light guide body.

In addition, in the lighting tool for a vehicle, after the light is split by a splitting portion provided on the light guide body, the light is emitted from the light emitting surface provided between one side and the other side of the light guide body with the splitting portion being sandwiched therebetween (for example, see Japanese Unexamined Patent Application, First Publication No. 2012-28156).

SUMMARY OF THE INVENTION

Incidentally, in the above-mentioned light guide body, brightness unevenness (emission unevenness) could occur on the light emitting surface due to a difference in optical path length of the light guided from the one end toward the other end. That is, when the brightness unevenness occurs on the light emitting surface of the light guide body, in the above-mentioned light emitting surface, a place where an optical path length is great gets relatively darker than a place where the optical path length is small. In particular, after the light emitted from the light source is split by the splitting portion provided on the light guide body, when the light is guided toward the one side and the other side in the light guide body, occurrence of the brightness unevenness is difficult to be suppressed due to a difference in optical path length of the light guided toward the one side and the other side from the splitting portion.

For this reason, in the invention disclosed in Japanese Unexamined Patent Application, First Publication No. 2012-28156, in the light entering the light guide body, a proportion of the light entering the reflection surface on the one side that reflects the light toward the light guide portion on the one side with respect to the splitting portion and a proportion of the light entering the reflection surface on the other side that reflects the light toward the light guide portion on the other side with respect to the splitting portion are adjusted according to a difference in length (optical path length) between the light guide portion on the one side and the light guide portion on the other side.

However, in the case of the above-mentioned configuration, as the difference in length between the light guide portion on the one side and the light guide portion on the other side is increased, it becomes more difficult to distribute the light toward the light guide portion on the short side from the splitting portion, resulting in irregular emission between the light guide portion on the one side and the light guide portion on the other side.

In particular, in the light guide portion extending to go around from the splitting portion toward the side of the light source, as the proportion of the distributed light is reduced, it becomes more difficult to guide the light guided into the light guide portion to a tip side. Accordingly, in this case, it is difficult to more uniformly emit light from the branched light emitting surfaces of the light guide body.

In addition, since the light entering the splitting portion is reflected by the reflection surfaces on the one side and the other side, a dark portion (emission unevenness) in which a portion in which the reflection surface is provided is darker than the other portions may occur. Also in this case, it is difficult to more evenly emit light from the branched light emitting surfaces of the light guide body.

An aspect of the present invention is directed to providing a lighting tool for a vehicle capable of more uniformly emitting light from branched light emitting surfaces of a light guide body.

An aspect of the present invention provides the following configurations.

(1) A lighting tool for a vehicle according to an aspect of the present invention including: a light source; and a light guide body configured to guide light emitted from the light source, wherein the light guide body has:

a first light guide portion disposed in front of the light source;

a second light guide portion that is branched off from the first light guide portion and that extends so as to go around toward a side of the light source;

an incidence portion that is located on a back surface side of the first light guide portion and that is configured to cause the light emitted from the light source to enter an inside of the first light guide portion; and a side emitting portion that is located on a side of the first light guide portion facing the second light guide portion and that is configured to emit some of the light entered from the incidence portion toward the second light guide portion.

(2) In the lighting tool for a vehicle of the aspect of the above-mentioned (1), the light guide body has a protrusion that protrudes from a side of the first light guide portion facing the second light guide portion toward a side of the light source, and the side emitting portion emits light from a side surface of the first light guide portion, which includes the protrusion, facing the second light guide portion (3) In the lighting tool for a vehicle of the aspect of the above-mentioned (2), the side emitting portion includes a plurality of first diffusion cuts configured to diffuse light emitted from the side emitting portion.

(4) In the lighting tool for a vehicle of the aspect of any one of the above-mentioned (1) to (3), the light guide body has:

a first reflection portion that is located on a front surface side of the first light guide portion and that is configured to reflect some of the light entering from the incidence portion toward the second light guide portion;

a plurality of first reflection cuts that are located on a back surface side of the second light guide portion and that are configured to reflect the light guided inside the second light guide portion toward a front surface side of the second light guide portion; and a first emitting portion that is located on a front surface side of the second light guide portion and that is configured to emit the light reflected by the plurality of first reflection cuts to an outside of the second light guide portion.

(5) In the lighting tool for a vehicle of the aspect of the above-mentioned (4), the first emitting portion includes a plurality of second diffusion cuts configured to diffuse the light emitted from the first emitting portion.

(6) In the lighting tool for a vehicle according to the aspect of any one of the above-mentioned (1) to (3), the light guide body has:

a second emitting portion that is located on a front surface side of the first light guide portion and that is configured to emit some of the light entered from the incidence portion to an outside of the first light guide portion; and a concave portion that is located between the incidence portion of the first light guide portion and the second emitting portion and that forms an air layer, the concave portion includes a light guide emission surface and a light guide incidence surface facing each other with the air layer being interposed therebetween in a direction of advance of the light entered from the incidence portion, and among the light entered from the incidence portion, after emission from the light guide emission surface to the air layer, the light entered the inside of the first light guide portion from the light guide incidence surface is emitted from the second emitting portion.

(7) In the lighting tool for a vehicle of the aspect of the above-mentioned (6), the second emitting portion includes a plurality of third diffusion cuts configured to diffuse the light emitted from the second emitting portion.

(8) In the lighting tool for a vehicle of the aspect of the above-mentioned (6), the light guide body has a second reflection portion configured to reflect some of the light guided inside the first light guide portion toward a bottom side of the concave portion and then reflect the light toward a front surface side of the first light guide portion.

(9) In the lighting tool for a vehicle of the aspect of any one of the above-mentioned (1) to (3), the light guide body has:

a third light guide portion that is branched off from the first light guide portion and that extends toward a side opposite to a side where the second light guide portion is located;

a third reflection portion that is located on a front surface side of the first light guide portion and that is configured to reflect some of the light entered from the incidence portion toward the third light guide portion;

a plurality of second reflection cuts that are located on a back surface side of the third light guide portion and that are configured to reflect the light guided inside the third light guide portion toward a front surface side of the third light guide portion; and a third emitting portion that is located on a front surface side of the third light guide portion and that is configured to emit the light reflected by the plurality of second reflection cuts to an outside of the third light guide portion.

(10) In the lighting tool for a vehicle of the aspect of the above-mentioned (9), the third emitting portion has:

a plurality of emission surfaces that are extending in an extension direction of the third light guide portion on a front surface side of the third light guide portion and that are arranged in a direction crossing the extension direction of the third light guide portion; and a groove portion that is located between adjacent ones of the plurality of emission surfaces and that extends in the extension direction of the third light guide portion, and the light reflected by the plurality of second reflection cuts is emitted to an outside from the plurality of emission surfaces.

(11) In the lighting tool for a vehicle of the aspect of the above-mentioned (10), the light guide body has a fourth reflection portion configured to reflect some of the light guided toward the third light guide portion in a direction crossing the extension direction of the third light guide portion and then reflect the light toward a front surface side of the third light guide portions located on both sides with the groove portion being interposed therebetween.

(12) In the lighting tool for a vehicle according to the aspect of the above-mentioned (9), the light guide body has a shape inclined or curved in a direction in which an outer side thereof is curved in a rearward direction than an inner side in the vehicle width direction in accordance with a slanted shape provided in a corner portion on a front end side or a rear end side of a vehicle, and the second light guide portion is located on an outer side in the vehicle width direction and the third light guide portion is located on the inner side in the vehicle width direction.

According to the aspects of the present invention, it is possible to provide a lighting tool for a vehicle capable of more uniformly emitting light from branched light emitting surfaces of a light guide body.

DETAILED DESCRIPTION OF THE INVENTION

Figure 1:
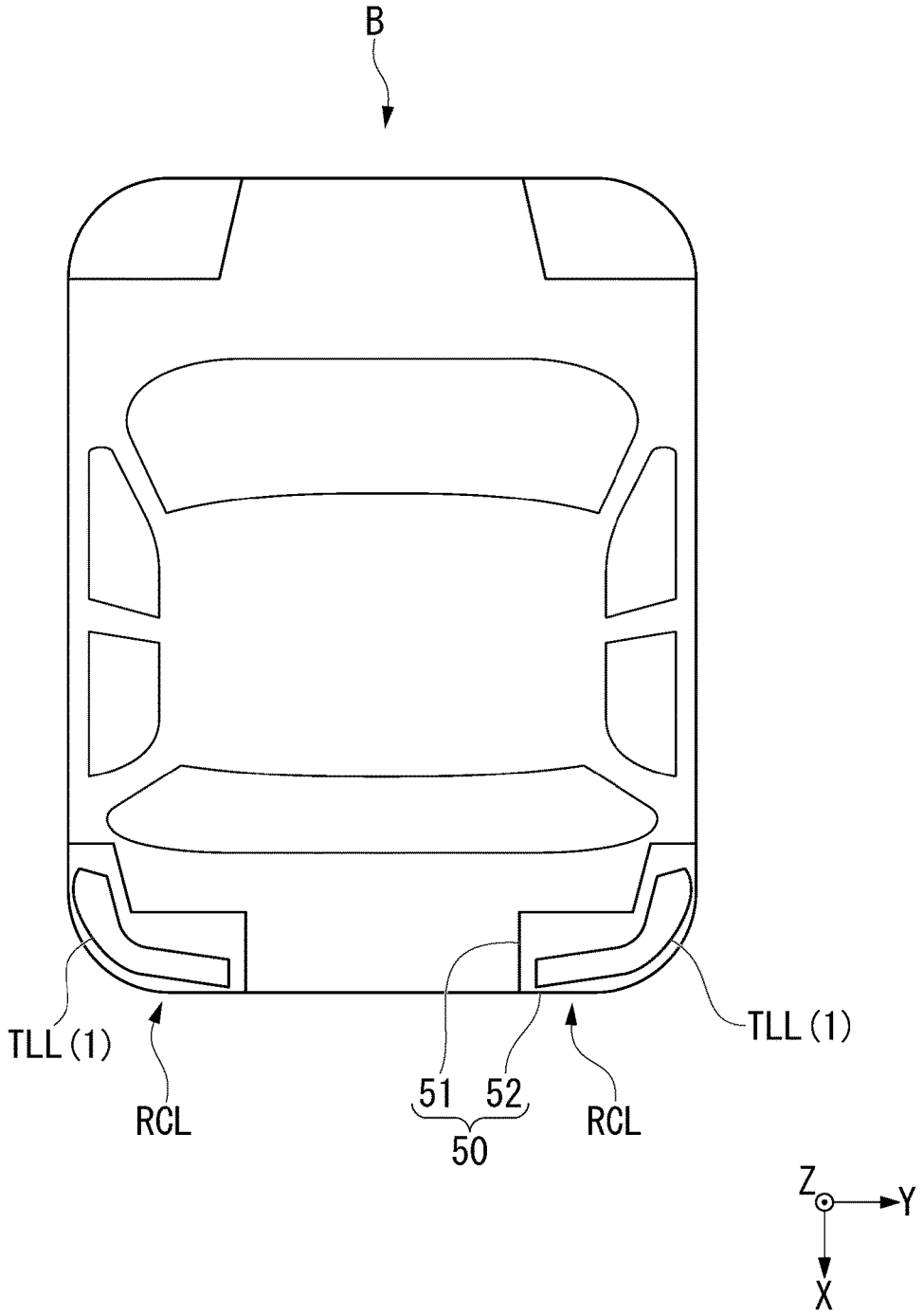
FIG. 1 is a plan view showing a vehicle on which a lighting tool for a vehicle according to an embodiment of the present invention is mounted.

Hereinafter, an embodiment of the present invention will be described in detail with reference to the accompanying drawings.

Further, in the drawings used in the following description, in order to make each component easier to see, dimensional scales may be different according to the component, and dimensional ratios or the like of each component are not limited to being the same as the actual ones.

As an embodiment of the present invention, for example, a lighting tool 1 for a vehicle shown in FIG. 1 to FIG. 13 will be described.

Figure 2:
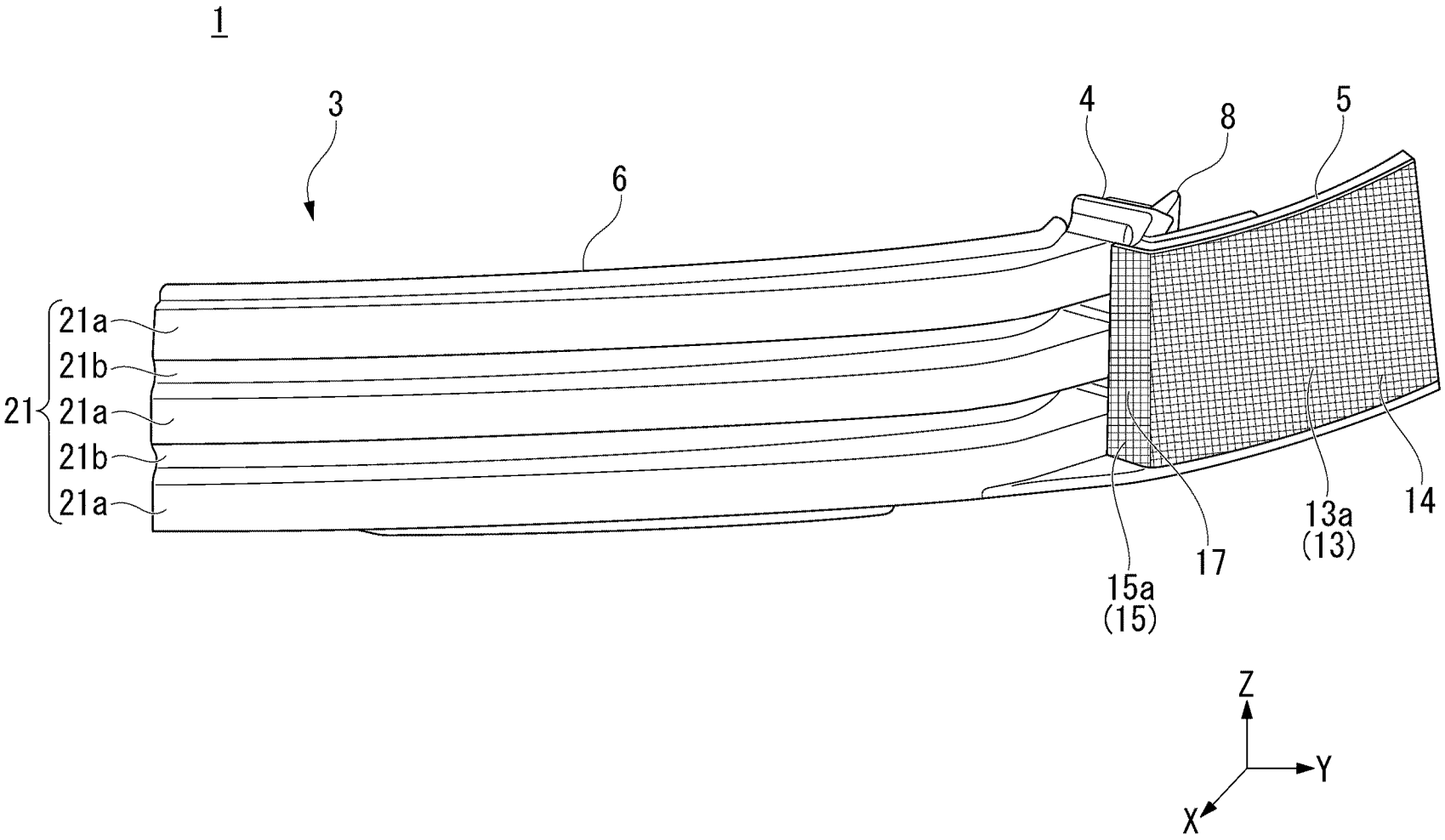
FIG. 2 is a perspective view showing the lighting tool for a vehicle shown in FIG. 1 when seen from a front surface side.
Figure 3:
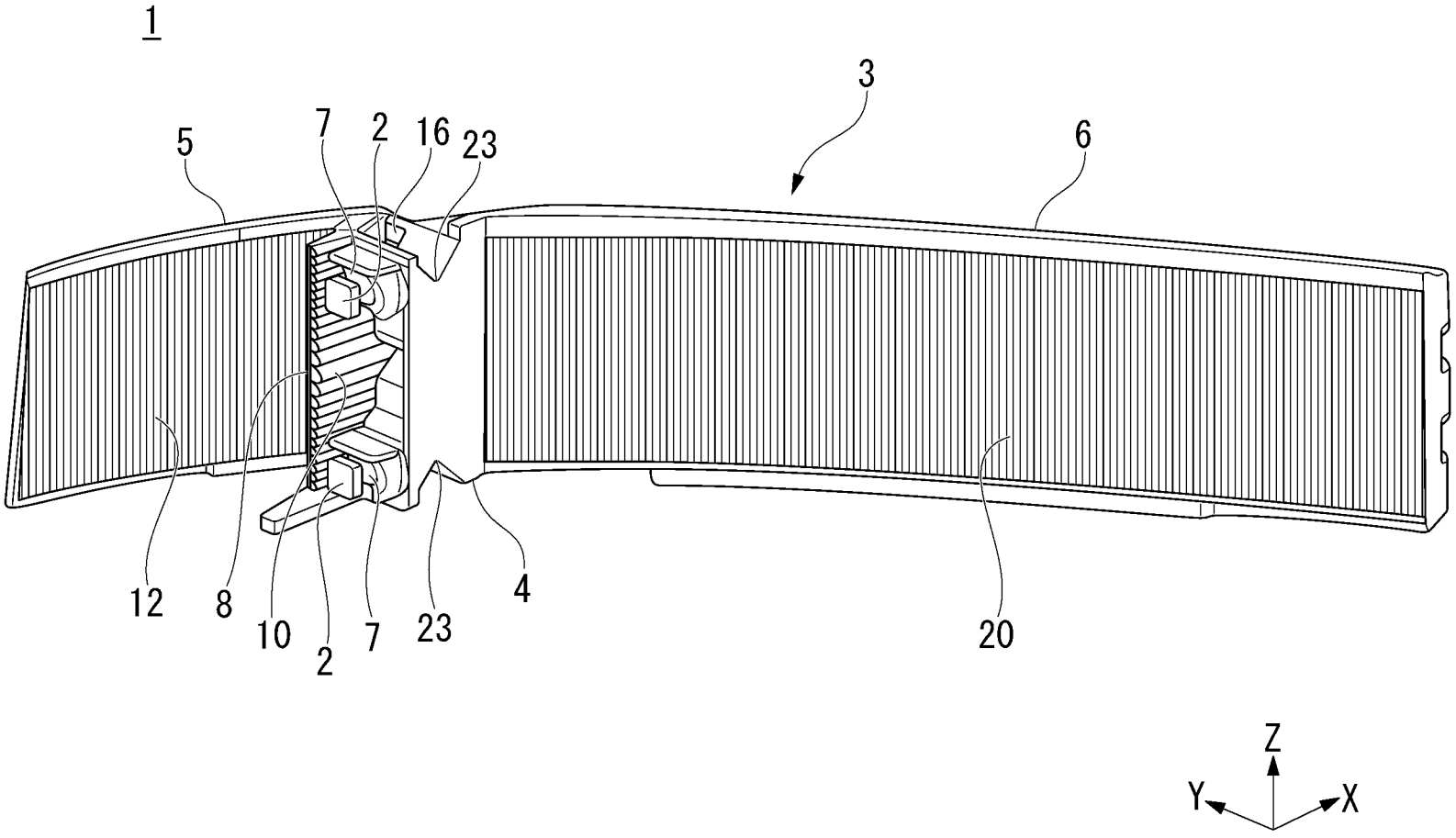
FIG. 3 is a perspective view of the lighting tool for a vehicle shown in FIG. 1 when seen from a back surface side.
Figure 4:
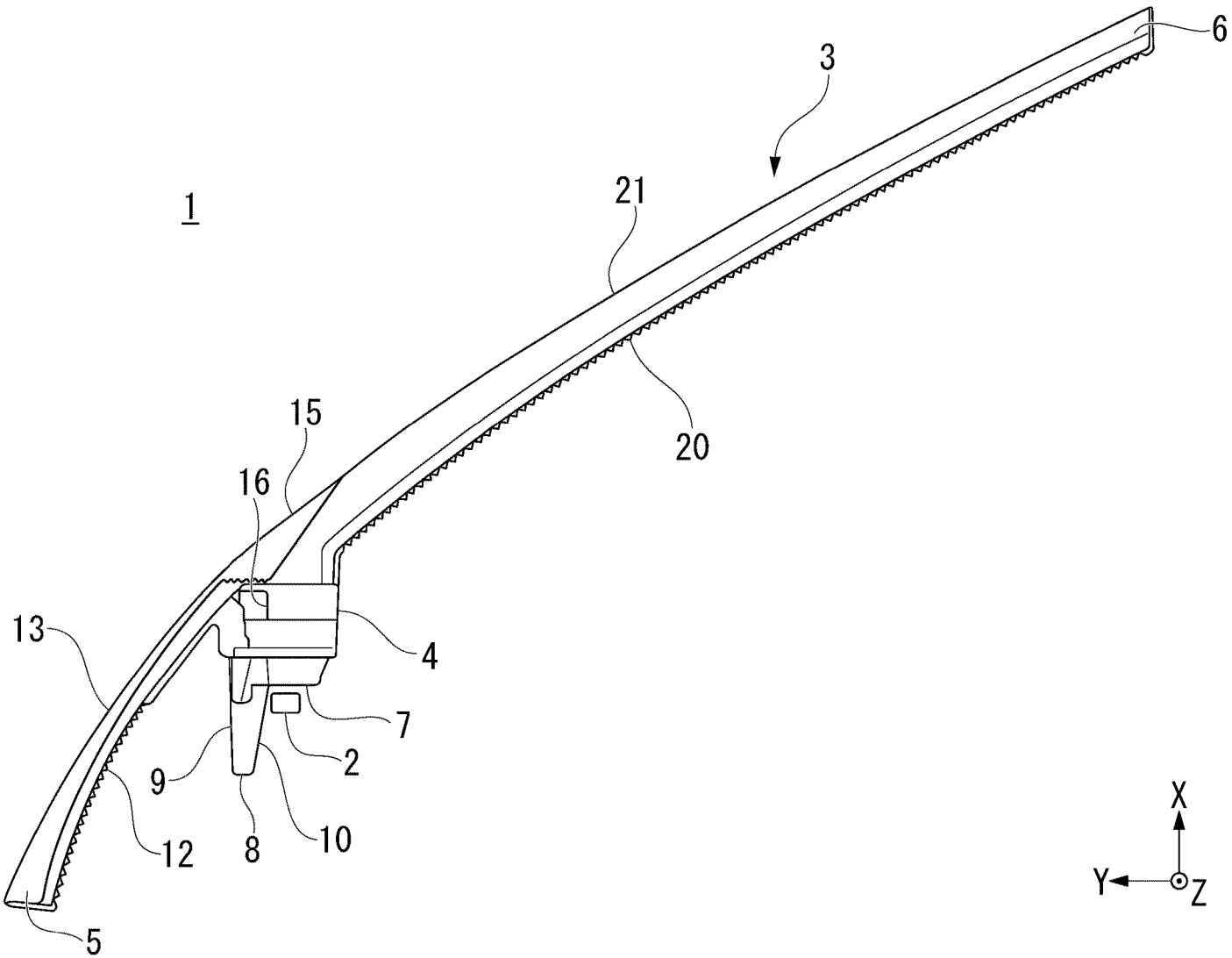
FIG. 4 is a plan view of the lighting tool for a vehicle shown in FIG. 1 when seen from above.
Figure 5:
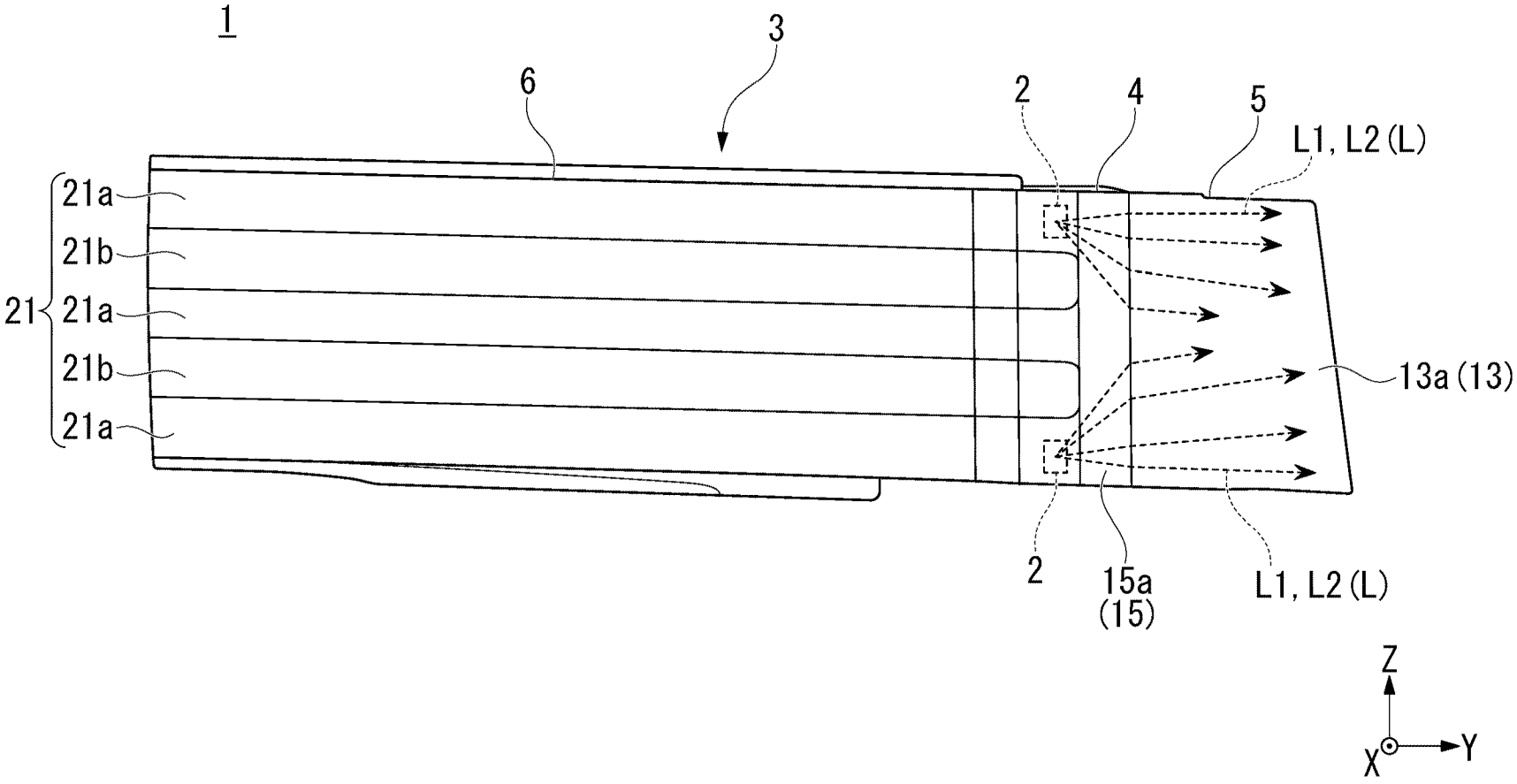
FIG. 5 is a front view showing an optical path of light guided toward a second light guide portion of a light guide body shown in FIG. 2.
Figure 6:
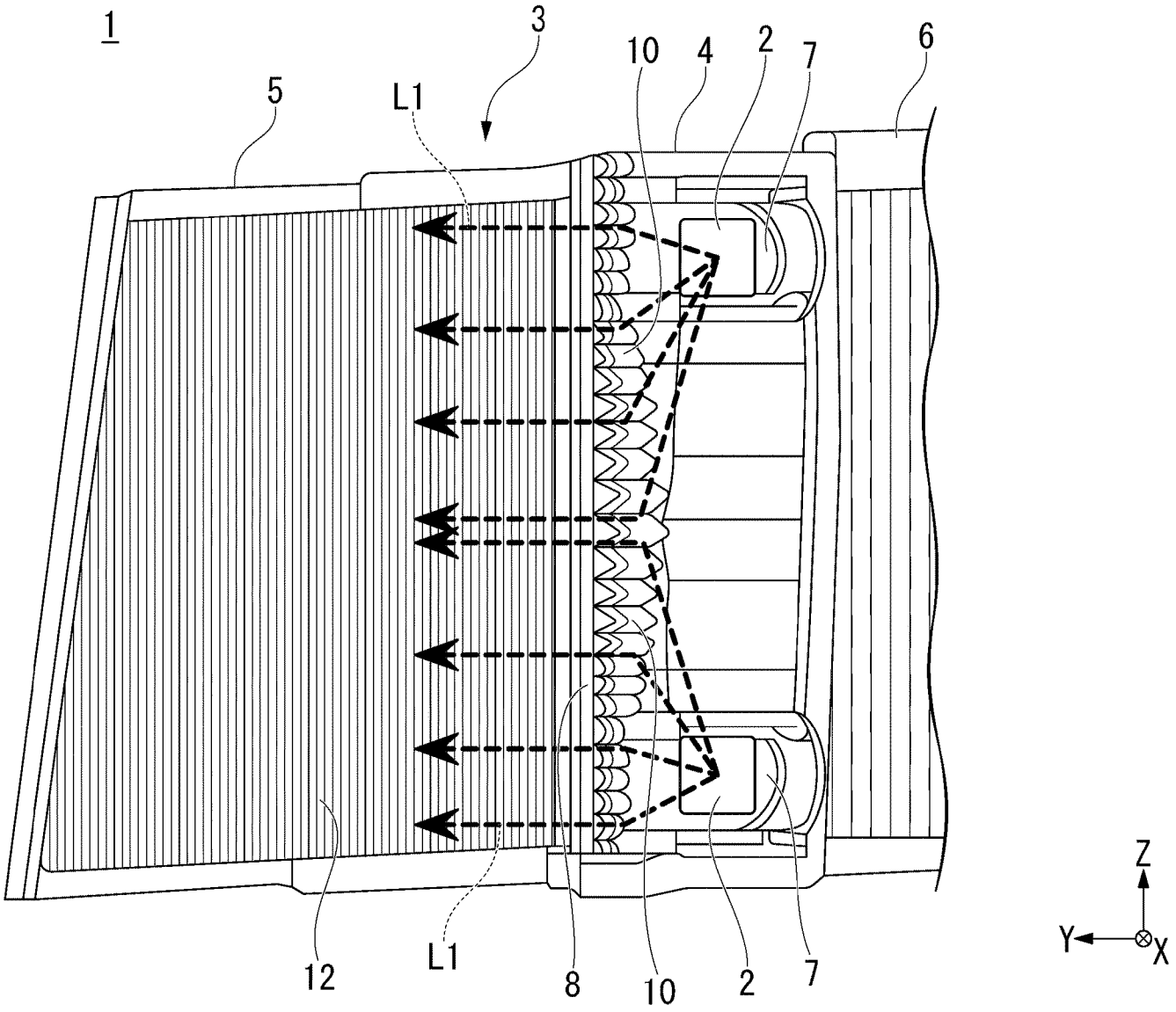
FIG. 6 is a rear view showing an optical path of light guided toward the second light guide portion of the light guide body shown in FIG. 3.
Figure 7:
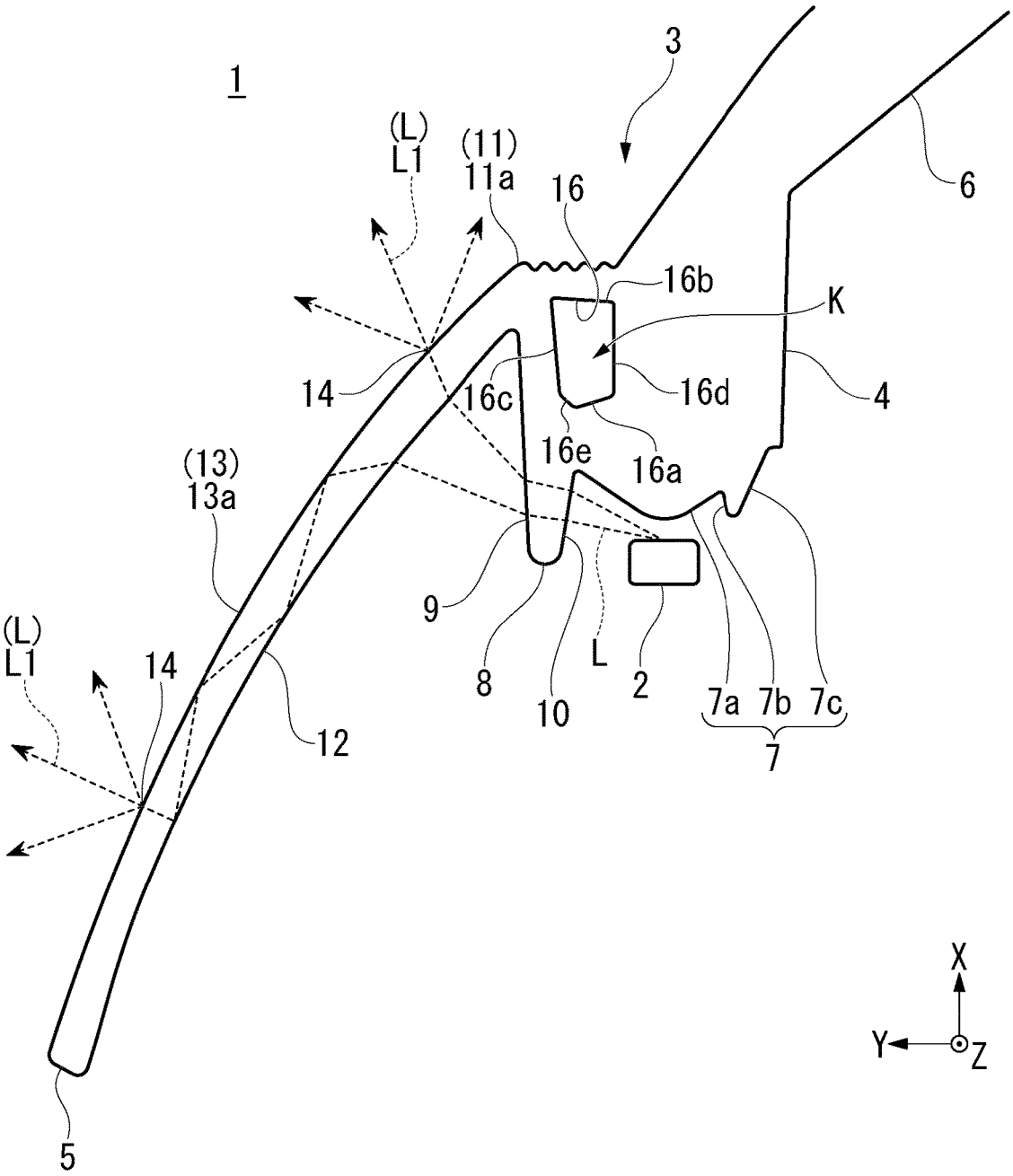
FIG. 7 is a horizontal cross-sectional view showing an optical path of light emitted toward the second light guide portion from a side emitting portion of the light guide body shown in FIG. 4.
Figure 8:
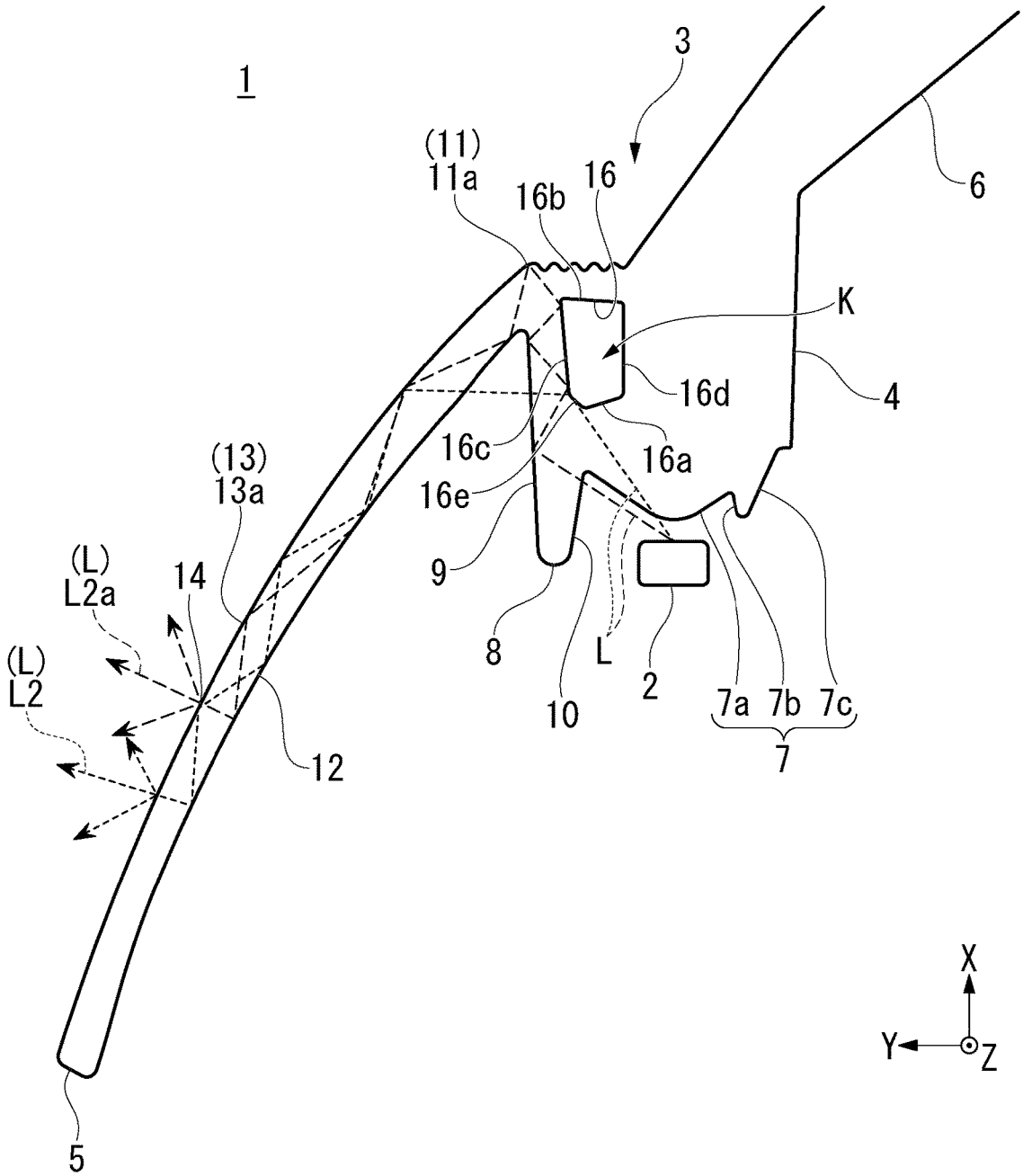
FIG. 8 is a horizontal cross-sectional view showing an optical path of light guided toward the second light guide portion of the light guide body shown in FIG. 4.
Figure 9:
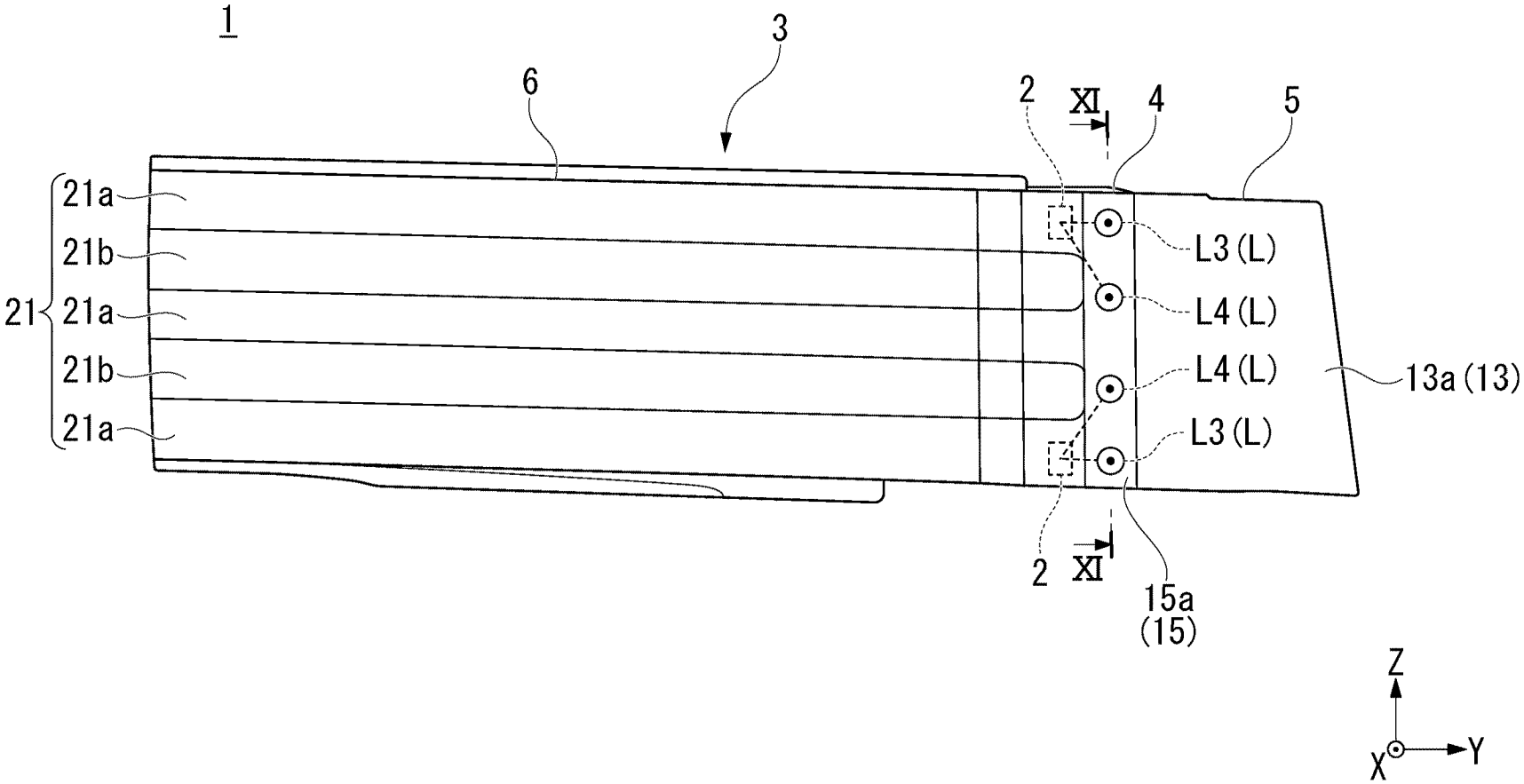
FIG. 9 is a front view showing an optical path of light guided toward a second emitting portion of the light guide body shown in FIG. 2.
Figure 10:
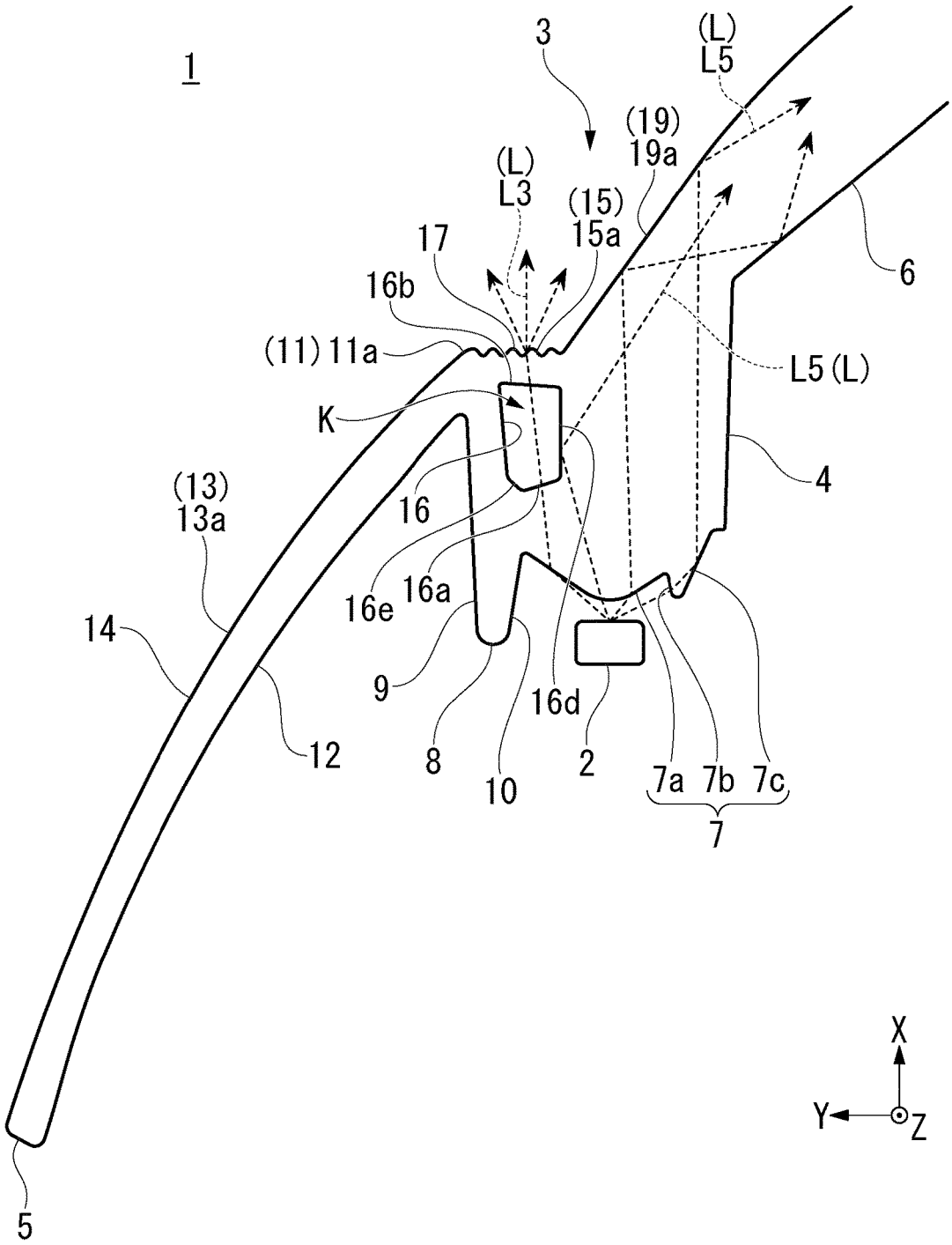
FIG. 10 is a horizontal cross-sectional view showing an optical path of light guided toward the second emitting portion of the light guide body shown in FIG. 4.
Figure 11:
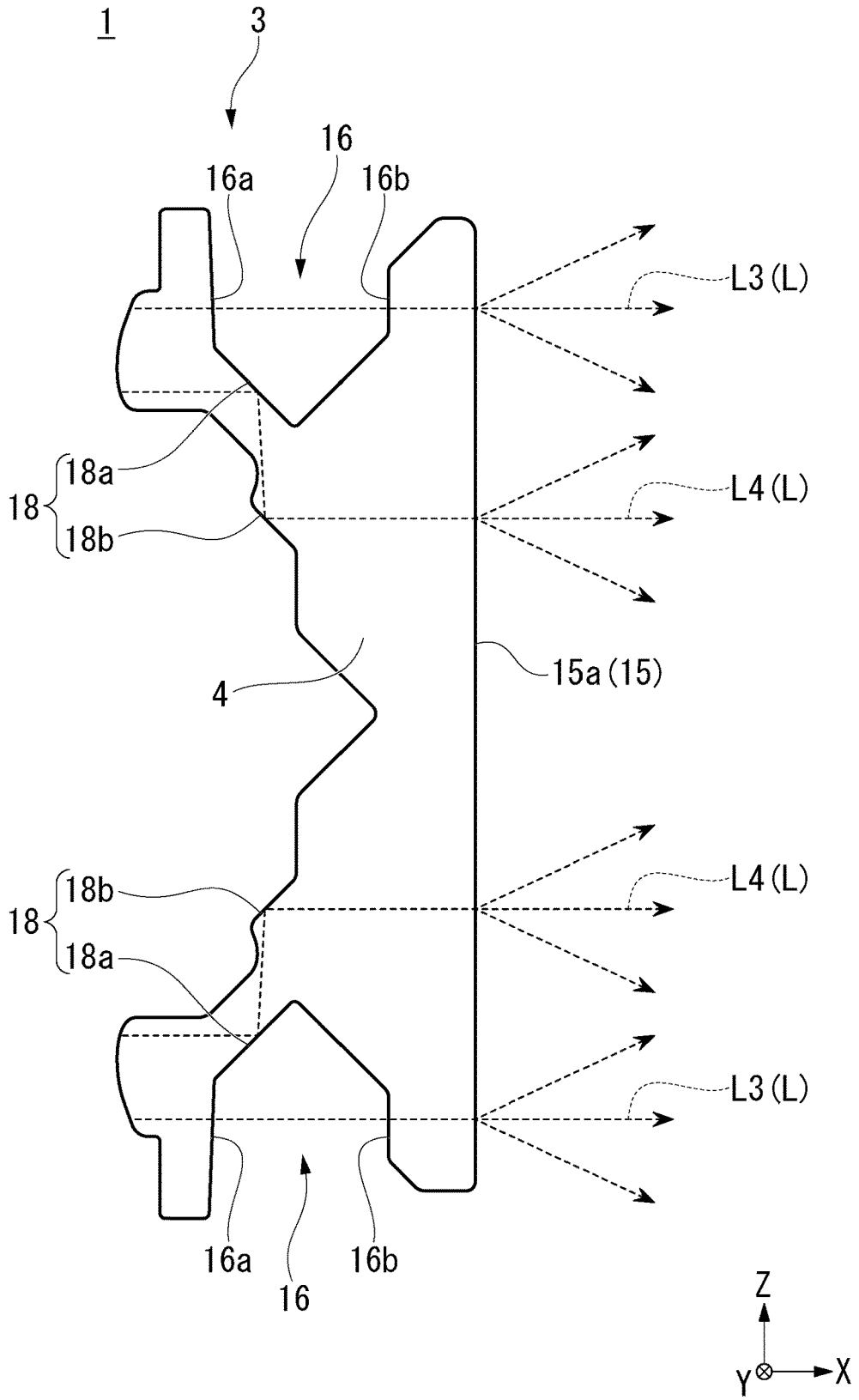
FIG. 11 is a vertical cross-sectional view showing an optical path of light guided toward the second emitting portion in a cross section of the light guide body along a line segment XI-XI shown in FIG. 9.
Figure 12:
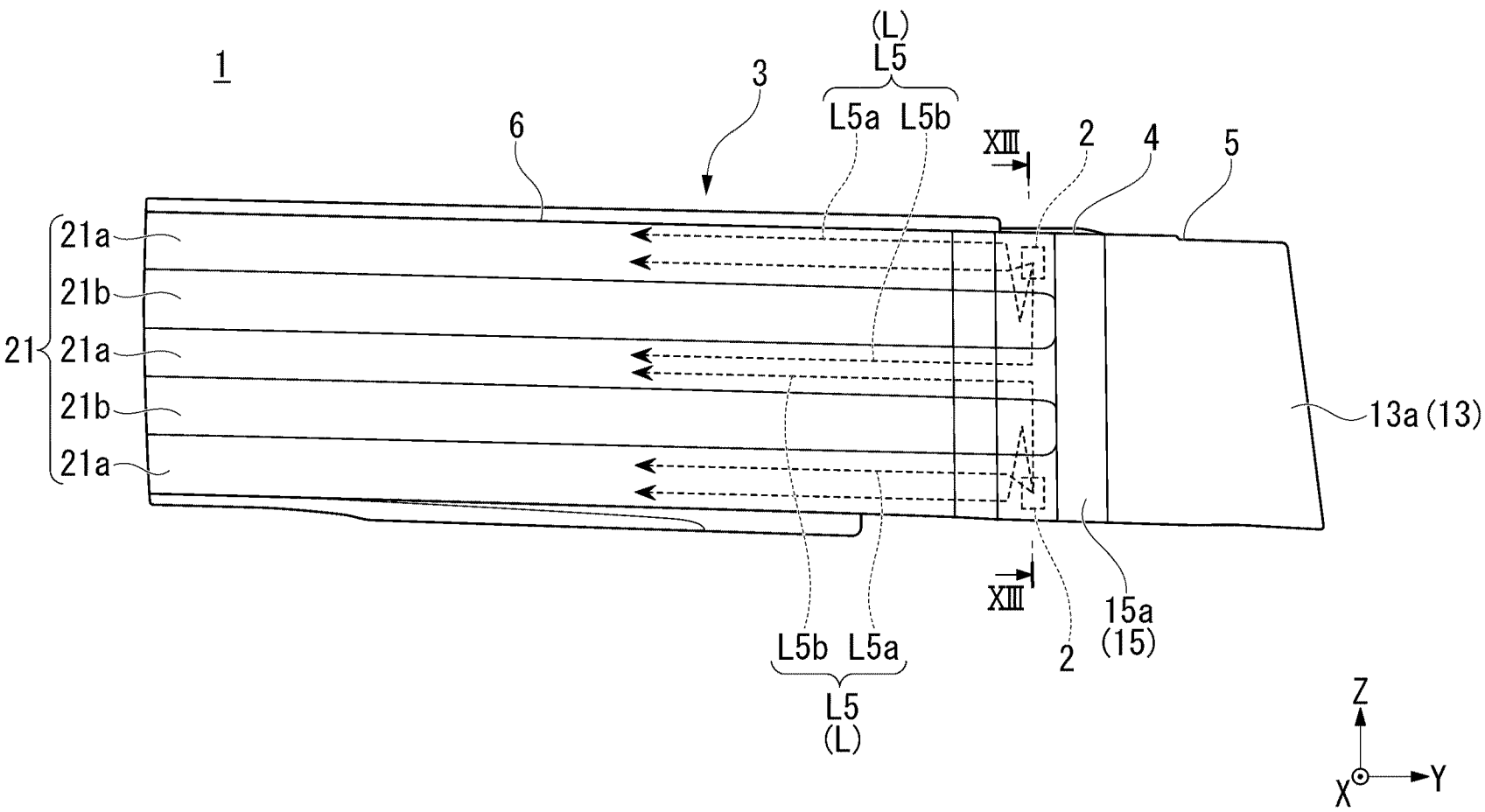
FIG. 12 is a front view showing an optical path of light guided toward a third light guide portion of the light guide body shown in FIG. 2.
Figure 13:
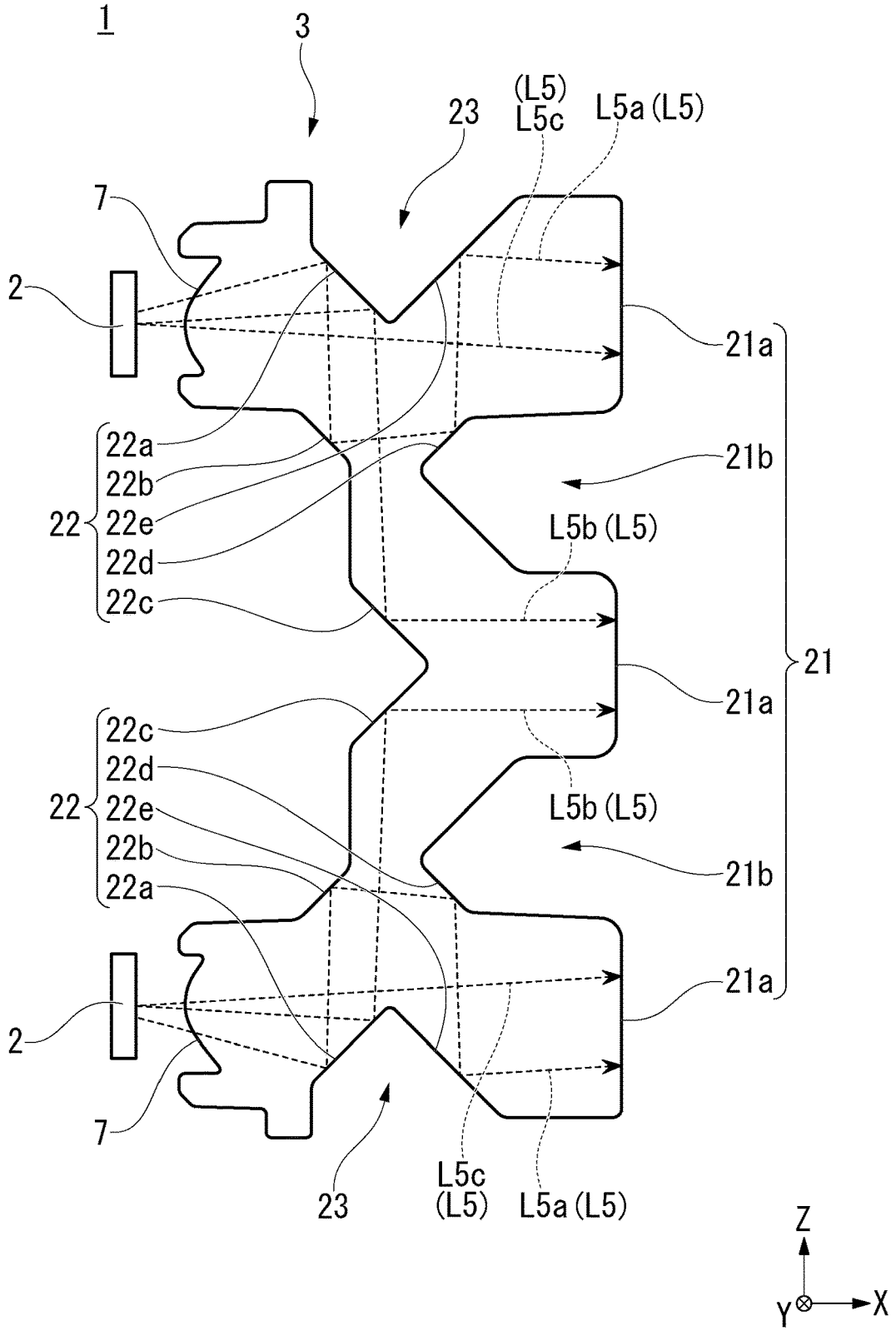
FIG. 13 is a vertical cross-sectional view showing an optical path of light guided toward the third light guide portion in a cross section of the light guide body along a line segment XIII-XIII shown in FIG. 12.

Further, FIG. 1 is a plan view showing a vehicle B on which the lighting tool 1 for a vehicle is mounted. FIG. 2 is a perspective view of the lighting tool 1 for a vehicle when seen from a front surface side. FIG. 3 is a perspective view of the lighting tool 1 for a vehicle when seen from a back surface side. FIG. 4 is a plan view of the lighting tool 1 for a vehicle when seen from above. FIG. 5 is a front view showing optical paths of lights L1 and L2 guided toward a second light guide portion 5 of a light guide body 3 shown in FIG. 2. FIG. 6 is a rear view showing the optical paths of the lights L1 and L2 guided toward the second light guide portion 5 of the light guide body 3 shown in FIG. 3. FIG. 7 is a horizontal cross-sectional view showing an optical path of the light L1 emitted toward the second light guide portion 5 from a side emitting portion 9 of the light guide body 3 shown in FIG. 4. FIG. 8 is a horizontal cross-sectional view showing optical paths of lights L2 and L2*a* guided toward the second light guide portion 5 of the light guide body 3 shown in FIG. 4. FIG. 9 is a front view showing optical paths of lights L3 and L4 guided toward a second emitting portion 15 of the light guide body 3 shown in FIG. 2. FIG. 10 is a horizontal cross-sectional view showing an optical path of light L3 guided toward the second emitting portion 15 of the light guide body 3 shown in FIG. 4. FIG. 11 is a vertical cross-sectional view showing optical paths of lights L3 and L4 guided toward the second emitting portion 15 in a cross section of the light guide body 3 along a line segment XI-XI shown in FIG. 9. FIG. 12 is a front view showing an optical path of light L5 guided toward a third light guide portion 6 of the light guide body 3 shown in FIG. 2. FIG. 13 is a vertical cross-sectional view showing optical paths of lights L5*a*, L5*b* and L5*c* guided toward the third light guide portion 6 in a cross section of the light guide body 3 along a line segment XIII-XIII shown in FIG. 12.

In addition, in the following drawings, an XYZ orthogonal coordinate system is set, an X-axis direction indicates a forward/rearward direction (lengthwise direction) of the lighting tool 1 for a vehicle, a Y-axis direction indicates a leftward/rightward direction (widthwise direction) of the lighting tool 1 for a vehicle, and a Z-axis direction indicates an upward/downward direction (height direction) of the lighting tool 1 for a vehicle.

As shown in FIG. 1, in the lighting tool 1 for a vehicle of the embodiment, among rear combination lamps RCL mounted on both corner portions of the vehicle B on a rear end side (in the embodiment, corner portions on a right rear end side), the present invention is applied to a tail lamp TLL that emits red light.

Further, directions of forward, rearward, leftward, rightward, upward and downward, in the following description are the same as directions when the lighting tool 1 for a vehicle is seen from a front surface (a rear side of a vehicle) unless the context clearly indicates otherwise. Accordingly, each direction when the vehicle B is seen from a front surface (a front side of the vehicle) is a direction opposite to each of the directions of forward, rearward, leftward and rightward.

Specifically, as shown in FIG. 2 to FIG. 4, the lighting tool 1 for a vehicle includes a plurality of (in the embodiment, two) light sources 2, and the light guide body 3 that is an inner lens, and has a structure in which these are disposed inside a lighting body 50 shown in FIG. 1.

Further, the lighting body 50 is constituted by a housing 51 having a front surface with an opening, and a transparent outer lens (cover lens) 52 configured to cover the opening of the housing 51.

In the embodiment, the outer lens 52 has a curved shape in which an outer side (a +Y axis side) thereof is curved in a rearward direction than an inner side (a −Y axis side) in a widthwise direction (Y-axis direction) of the vehicle B (hereinafter, referred to as "a vehicle width direction") in accordance with a slanted shape provided in a corner portion of the vehicle B on the rear end side.

Further, the outer lens 52 is not limited to such a curved shape and may have a shape inclined in which the outer side thereof is curved in a rearward direction than the inner side in the vehicle width direction. In addition, the shape of the lighting body 50 may be appropriately changed according to a design or the like of the vehicle B.

As shown in FIG. 3 to FIG. 8, the plurality of light sources 2 are constituted by LEDs configured to emit red light (hereinafter, referred to as "light") L, are mounted on a surface of a circuit board (not shown) on which a driving circuit configured to drive the LEDs is provided, and radially emit the light L toward the rear of the vehicle B.

The plurality of light sources 2 are disposed in the upward/downward direction (Z-axis direction) of the vehicle B while having an interval with each other. In addition, the plurality of light sources 2 have a configuration in which they are provided on the same surface of the same circuit board and they both radially emit the light L in the same direction.

As shown in FIG. 2 to FIG. 8, the light guide body 3 is constituted by a light transmissive member, for example, a transparent resin such as poly carbonate, acryl, or the like, a glass, or the like, and has a curved long plate shape in which an outer side thereof is curved in rearward direction than an inner side thereof in the vehicle width direction as a whole in accordance with a slanted shape provided in the corner portion of the vehicle B on the rear end side.

Specifically, the light guide body 3 has a plurality of (in the embodiment, two) first light guide portions 4 disposed in front of the light sources 2, respectively, the second light guide portions 5 branched off from the first light guide portions 4 and extends so as to go around toward a side of the light sources 2, and the third light guide portions 6 branched off from the first light guide portions 4 and extending toward a side opposite to a side where the second light guide portions 5 are located.

Among these, the first light guide portion 4 is provided to protrude toward a back surface side (−X axis side) of the light guide body 3 from between the second light guide portion 5 and the third light guide portion 6. Meanwhile, the second light guide portion 5 is located on an outer side in the vehicle width direction with respect to the first light guide portion 4, and provided to extend to be shorter than the third light guide portion 6 along a curve on a side of the vehicle B. Meanwhile, the third light guide portion 6 is located on an inner side in the vehicle width direction with respect to the first light guide portion 4, and provided to extend to be longer than the second light guide portion 5 along a curve on the rear of the vehicle B.

The light guide body 3 has a plurality of (in the embodiment, two) incidence portions 7 located in the first light guide portions 4 on the back surface side and configured to cause light L emitted from the light sources 2 to enter the inside of the first light guide portions 4. The plurality of incidence portions 7 are disposed on both sides of the first light guide portions 4 in the upward/downward direction (Z-axis direction) to correspond to the plurality of light sources 2, respectively.

Each of the incidence portions 7 has a first condensing incidence surface 7*a* located at a center of a portion facing each of the light sources 2 and into which some of the light L emitted from the light source 2 enters, a second condensing incidence surface 7*b* located on an inner circumferential side of a portion protruding toward the light source 2 from a position surrounding the first condensing incidence surface 7*a* and into which some of the light L emitted from the light source 2 enters, and a condensing reflection surface 7*c* located on an outer circumferential side of the protruded portion and configured to reflect the light L entering from the second condensing incidence surface 7*b*.

In the incidence portion 7, among the light L emitted from the light source 2, the light L entering from the first condensing incidence surface 7*a* is condensed closer to an optical axis of the light L emitted from the light source 2. Meanwhile, the light L entering from the second condensing incidence surface 7*b* is reflected by the condensing reflection surface 7*c* and is condensed closer to the vicinity of the optical axis of the light L emitted from the light source 2.

Accordingly, in the incidence portion 7, the light L radially emitted from the light source 2 enters the inside of the first light guide portion 4 while being parallelized and condensed. In addition, the light L entering from the incidence portion 7 is guided toward the front surface side (+X axis side) of the first light guide portion 4.

The light guide body 3 has a protrusion 8 protruding toward a side of the light source 2 from a side of the first light guide portion 4 facing the second light guide portion 5 (+Y axis side). The protrusion 8 is provided to protrude unit a position where at least the light L radially emitted from the light source 2 enters, preferably a position facing a side surface of the light source 2. Accordingly, in the incidence portion 7, the light L emitted from the light source 2 can enter the inside of the protrusion 8 (the first light guide portion 4) from the side surface of the protrusion 8 on the inner side (−Y axis side).

The light guide body 3 has the side emitting portion 9 that is located on the side surface on the side (+Y axis side) of the first light guide portion 4, which includes the protrusion 8, facing the second light guide portion 5 and that is configured to emit some of the light L1 entering from the incidence portion 7 toward the second light guide portion 5.

The side emitting portion 9 has a plurality of first diffusion cuts 10 configured to diffuse the light L1 emitted from the side emitting portion 9 in the upward/downward direction. In the embodiment, as the first diffusion cuts 10, knurls that are located on the side surface (inner side) of the protrusion 8 which faces the light source 2 and that are extending in the protrusion direction of the protrusion 8 are arranged in the upward/downward direction of the protrusion 8.

The plurality of first diffusion cuts 10 are provided to protrude from the side surface of the protrusion 8 facing the light source 2 in a cylindrical shape. In addition, the shape of the knurls is not limited to a curve shape curved in the above-mentioned cylindrical shape and may be a polygonal shape constituted by a plurality of surfaces.

In addition, regarding the plurality of first diffusion cuts 10, in order to uniformly diffuse the light L1 emitted from the side emitting portion 9 in the upward/downward direction, the height of the knurls arranged in the upward/downward direction of the protrusion 8 is set to be increased as it goes away from the light source 2. That is, the height of the knurls arranged in the upward/downward direction of the protrusion 8 is set to be gradually increased toward the central portion of the protrusion 8 in the upward/downward direction which is far from the light sources 2 disposed on both sides in the upward/downward direction.

Here, in a case the knurls close to the light sources 2*a* and 2*b* and the knurls far from the light sources 2*a* and 2*b* have substantially the same height, among the light L emitted from the light sources 2*a* and 2*b*, since the light L advances toward the knurls close to the light sources 2*a* and 2*b* has a small (an acute angle) emission angle (an angle of the light L emitted from the light sources 2*a* and 2*b* with respect to the optical axis), it is possible to cause the light L to enter the knurls even when the height of the knurls is low.

On the other hand, since the light L advances toward the knurls far from the light sources 2*a* and 2*b* has a large emission angle (close to an obtuse angle), it will be difficult for the light L to enter the knurls in a case the height of the knurls is low, and the incidence efficiency will deteriorate.

In the embodiment, since the height of the knurls is gradually increased toward the far position from the position close to the light sources 2*a* and 2*b*, it is possible for the light L to efficiently enter the knurls far from the light sources 2*a* and 2*b*.

In addition, since the light L entering the knurls is refracted by the curve surface of the knurls (the first diffusion cuts 10), enters the inside of the first light guide portion 4 from the back surface side of the first light guide portion 4 while being diffused in the upward/downward direction, and is emitted from a first emitting portion 13 on a front surface side of the first light guide portion 4, it is possible to contribute to uniform emission of the second light guide portion 5, which will be described below.

Further, it is not limited to the configuration in which the plurality of first diffusion cuts 10 are disposed on the side surface (inner side) of the protrusion 8 facing the light source 2 and may have a configuration in which they are disposed in the side surface (outer side) of the protrusion 8 facing the second light guide portion 5.

In addition, it is not limited to the configuration in which the plurality of first diffusion cuts 10 are constituted by the above-mentioned plurality of knurls, any other configuration may be provided as long as having the diffusion function, and the light L1 emitted from the above mentioned side emitting portion 9 may be diffused not only in the upward/downward direction (vertical direction) but also in the leftward/rightward direction (horizontal direction).

The light guide body 3 has a first reflection portion 11 that is located on the front surface side of the first light guide portion 4 and that is configured to reflect the light L2, which is some of the light L entering from the incidence portion 7, toward the second light guide portion 5, a plurality of first reflection cuts 12 that is located on the back surface side of the second light guide portion 5 and that is configured to reflect the light L2 guided inside the second light guide portion 5 toward the front surface side of the second light guide portion 5, and the first emitting portion 13 that is located on the front surface side of the second light guide portion 5 and that is configured to emit the light L2 reflected by the plurality of first reflection cuts toward the outside of the second light guide portion 5.

The first reflection portion 11 is constituted by a first inclined surface 11*a* that is located on the front surface side of the first light guide portions 4 in the vicinity of the boundary with the second light guide portion 5 and that is inclined along the curve of the second light guide portion 5. The light L2 entering the first inclined surface 11*a* is reflected toward the second light guide portion 5 by the first reflection portion 11.

Further, in the first reflection portion 11, the light L2 entering the first inclined surface 11*a* may transmit through the first inclined surface 11*a* according to an angle thereof.

The plurality of first reflection cuts 12 may have any configuration as long as it reflects the light L2 entering the back surface side of the second light guide portion 5 at an angle that the light L2 is emitted (transmitted) to the outside from the front surface side of the second light guide portion 5, and a shape, a size or a number thereof is not particularly limited. In the embodiment, as the first reflection cuts 12, groove portions having a substantially triangular cross section formed by cutting out the back surface of the second light guide portion 5 in the upward/downward direction are arranged in the extension direction of the second light guide portion 5.

In addition, in the embodiment, intervals next to each other of the first reflection cuts 12 are equal. Meanwhile, in order to more uniformly emit light from the first reflection cuts 12 which will be described below, the intervals next to each other of the first reflection cuts 12 may be gradually reduced or a depth of the groove portion that form the first reflection cuts 12 may be gradually increased from the base end side (−Y axis side) toward the tip side (+Y axis side) of the second light guide portion 5.

The first emitting portion 13 has a first emission surface 13*a* located on the front surface side of the second light guide portion 5. In addition, a plurality of second diffusion cuts 14 configured to diffuse the lights L1 and L2 emitted toward the outside from the first emission surface 13*a* are provided on the first emission surface 13*a*.

As the second diffusion cuts 14, for example, a lens cut referred to as a flute cut or a fisheye cut, a concavo-convex structure formed by performing knurls processing or emboss processing, or the like, may be exemplified. In addition, it is possible to control a diffusion level of the lights L1 and L2 emitted from the first emission surface 13*a* by adjusting a shape or the like of the second diffusion cuts 14.

In the embodiment, as the second diffusion cuts 14, the fisheye cut configured to diffuse the lights L1 and L2 emitted from the first emission surface 13*a* in the upward/downward direction and the leftward/rightward direction is provided.

In the first emitting portion 13, as shown in FIG. 7, after the light L1 emitted from the side emitting portion 9 enters from the back surface side of the second light guide portion 5, the light L1 is emitted to the outside from the first emission surface 13*a* that is on the front surface side of the second light guide portion 5. In addition, as shown in FIG. 8, in the first emitting portion 13, the light L2 guided inside the second light guide portion 5 is emitted to the outside from the first emission surface 13*a*.

As shown in FIG. 2 to FIG. 4 and FIG. 9 to FIG. 11, the light guide body 3 has the second emitting portion 15 that is disposed on the front surface side of the first light guide portion 4 and that is configured to emit the light L3, which is some of the light L entering from the incidence portions 7, to the outside of the first light guide portion 4, and a plurality of (in the embodiment, two) concave portions 16 that are located between each of the incidence portions 7 of the first light guide portions 4 and the second emitting portion 15 and that form an air layer K.

The plurality of concave portions 16 form the air layers K inside thereof by cutting out parts of the upper surfaces and the lower surfaces of the first light guide portions 4 in the depth direction (Z-axis direction). In addition, each of the concave portions 16 has a light guide emission surface 16*a* and a light guide incidence surface 16*b* facing each other with the air layer K being interposed therebetween in a direction of advance (+X-axis direction) of the light L entering from the incidence portions 7, a pair of light guide reflection surfaces 16*c* and 16*d* facing each other with the air layer K being interposed therebetween in a direction (Y-axis direction) crossing the direction of advance of the light L entering from the incidence portions 7, and a light guide reflection surface 16*e* inclined obliquely between the light guide emission surface 16 and the light guide reflection surface 16*c* on one side.

The second emitting portion 15 has a second emission surface 15*a* located on the front surface side of the first light guide portion 4. In addition, a plurality of third diffusion cuts 17 configured to diffuse the light L3 emitted toward the outside from the second emission surface 15*a* are provided on the second emission surface 15*a*.

As the third diffusion cuts 17, for example, a lens cut referred to as a flute cut or a fisheye cut, a concavo-convex structure formed by performing knurls processing or emboss processing, or the like, may be exemplified. In addition, it is possible to control a diffusion level of the light L3 emitted from the second emission surface 15*a* by adjusting a shape or the like of the third diffusion cuts 17.

In the embodiment, as the third diffusion cuts 17, the fisheye cut configured to diffuse the light L3 emitted from the second emission surface 15*a* in the upward/downward direction and the leftward/rightward direction is provided.

In the second emitting portion 15, as shown in FIG. 10, in the light L entering from the incidence portions 7, after emission from the light guide emission surface 16*a* to the air layer K, the light L3 entering the inside of the first light guide portions 4 from the light guide incidence surface 16*b* is emitted to the outside from the second emission surface 15*a*.

In addition, in the light guide body 3, as shown in FIG. 8, the light L2 can be guided toward the first reflection portion 11 while repeating reflection between the side surface of the first light guide portion 4 facing the second light guide portion 5 and the light guide reflection surface 16*c* on one of the concave portions 16. Since the light L2 reflected by the first reflection portion 11 is guided toward the tip side from the base end side of the second light guide portion 5 while repeating reflection inside the second light guide portion 5, it is possible to contribute to uniform emission of the second light guide portion 5.

In addition, in the light guide body 3, among the light L2 guided toward the first reflection portion 11, light L2*a* reflected by the light guide reflection surface 16*e* can be emitted toward the second light guide portion 5 from the side emitting portion 9. The light L2*a* emitted toward the second light guide portion 5 from the side emitting portion 9 enters from the back surface side of the second light guide portion 5, and then, is emitted to the outside from the first emission surface 13*a* that is on the front surface side of the second light guide portion 5. Accordingly, it is possible to contribute to uniform emission of the second light guide portion 5.

As shown in FIG. 11, the light guide body 3 has a second reflection portion 18 configured to reflect light L4, which is some of the light L guided into the first light guide portion 4, toward the bottom side of the concave portion 16, and then, reflect the light L4 toward the second emission surface 15*a* (the second emitting portion 15) that is on the front surface side of the first light guide portion 4.

The second reflection portion 18 has a 2*a*$^{th}$ inclined surface 18*a* that is located on a bottom side of the concave portions 16 disposed on both sides of the first light guide portion 4 in the upward/downward direction and that is configured to reflect the light L4 guided inside the first light guide portion 4 toward a center side of the first light guide portion 4 in the upward/downward direction, and a 2*b*$^{th}$ inclined surface 18*b* that is located on a back surface side of the first light guide portion 4 and that is configured to reflect the light L4 reflected by the 2*a*$^{th}$ inclined surface 18*a* toward the front surface side of the first light guide portion 4.

Accordingly, in the light guide body 3, it is possible to emit the lights L3 and L4 in the upward/downward direction of the second emission surface 15*a* (the second emitting portion 15).

As shown in FIG. 2 to FIG. 4, FIG. 10, FIG. 12 and FIG. 13, the light guide body 3 has a third reflection portion 19 that is located on a front surface side of the first light guide portion 4 and that is configured to reflect the light L5, which is some of the light L entering from the incidence portion 7, toward the third light guide portion 6, a plurality of second reflection cuts 20 that is located on a back surface side of the third light guide portion 6 and that is configured to reflect the light L5 guided inside the third light guide portion 6 toward a front surface side of the third light guide portion 6, and a third emitting portion 21 that is located on a front surface side of the third light guide portion 6 and that is configured to emit the light L5 reflected by the plurality of second reflection cuts 20 to the outside of the third light guide portion 6.

The third reflection portion 19 is constituted by a third inclined surface 19*a* that is located on a front surface side of the first light guide portion 4 between the second emitting portion 15 and the third light guide portion 6 and that is inclined along a curve of the third light guide portion 6. The light L5 entering the third inclined surface 19*a* is reflected toward the third light guide portion 6 by the third reflection portion 19.

Further, in the third reflection portion 19, the light L5 entering the third inclined surface 19*a* may transmit through the third inclined surface 19*a* according to an angle of the light L5. Accordingly, it is possible to emit light from the portion corresponding to the third inclined surface 19*a*. That is, since the third inclined surface 19*a* can also emit light in addition to the first emission surface 13*a*, the second emission surface 15*a* and a third emission surface 21*a*, it is possible to emit light from the entire of the front surface side of the light guide body 3 without shielding the third inclined surface 19*a* by extension and the like.

In addition, in the light guide body 3, as shown in FIG. 10, it is possible to reflect the light L5, which is some of the light L entering from the incidence portion 7, at the other light guide reflection surface 16*d* of the concave portion 16, and to guide the light toward the third light guide portion 6.

Here, in the light guide body 3, among the light L entering the first light guide portion 4, a proportion of the light L2 entering the first inclined surface 11*a* reflected toward the second light guide portion 5 and a proportion of the light entering the third inclined surface 19*a* reflected toward the third light guide portion 6 are adjusted according to a difference in length (optical path length) between the second light guide portion 5 and the third light guide portion 6.

That is, in the light guide body 3, since the third light guide portion 6 is longer than the second light guide portion 5, a proportion of the light L5 entering the third inclined surface 19*a* is adjusted to be greater than a proportion of the light L2 entering the first inclined surface 11*a*. Accordingly, in the light L entering the first light guide portion 4, a proportion of the light L5 guided toward the third light guide portion 6 is greater than that of the light L2 guided toward the second light guide portion 5.

The plurality of second reflection cuts 20 may have any configuration as long as it reflects the light L5 entering the back surface side of the third light guide portion 6 at an angle that the light is emitted (transmitted) to the outside from the front surface side of the third light guide portion 6, and a shape, a size or a number thereof is not particularly limited. In the embodiment, as the second reflection cuts 20, groove portions having a substantially triangular cross section obtained by cutting out the back surface of the third light guide portion 6 in the upward/downward direction are arranged in the extension direction of the third light guide portion 6.

In addition, in the embodiment, intervals next to each other of the second reflection cuts 20 are equal. Meanwhile, in order to more uniformly emit light from the second reflection cuts 20 which will be described below, the intervals next to each other of the second reflection cuts 20 may be gradually reduced or a depth of the groove portion that forms the second reflection cuts 20 may be gradually increased from the base end side (+Y axis side) toward the tip side (−Y axis side) of the third light guide portion 6.

The third emitting portion 21 has a plurality of (in the embodiment, three) third emission surfaces 21*a* that are extending in a stripe shape in the extension direction (in the embodiment, the vehicle width direction) of the third light guide portion 6 on the front surface side of the third light guide portion 6 and that are arranged in a direction (in the embodiment, the upward/downward direction) crossing the extension direction of the third light guide portion 6.

In addition, a plurality of (in the embodiment, two) groove portions 21*b* extending in a stripe shape in the extension direction (in the embodiment, the vehicle width direction) of the third light guide portion 6 are provided between the plurality of third emission surfaces 21*a*, which are adjacent to each other. The groove portions 21*b* constitute a portion of the third light guide portion 6 on the front surface side that does not emit light (non-emission portion).

As shown in FIG. 12 and FIG. 13, the light guide body 3 has a fourth reflection portion 22 that is configured to reflect the lights L5*a* and L5*b*, which are some of the light L5 guided toward the third light guide portion 6, in a direction (upward/downward direction) crossing the extension direction of the third light guide portion 6, and then, that is configured to reflect the lights toward the front surface side of the third light guide portions 6 located on both sides with the groove portion 21*b* being interposed therebetween.

The fourth reflection portion 22 has a groove portion 23 having a substantially triangular cross section formed by cutting out parts of the upper surface and the lower surface of the first light guide portion 4 in the widthwise direction (Y-axis direction), a 4*a*$^{th}$ inclined surface 22*a* located on a back surface side of the groove portion 23 and configured to reflect the lights L5 and L5*b* guided toward the third light guide portion 6 towards a center side of the first light guide portion 4 in the upward/downward direction, a 4*b*$^{th}$ inclined surface 22*b* located on a back surface side of the first light guide portion 4 and configured to reflect the light L5*a* reflected by the 4*a*$^{th}$ inclined surface 22*a* toward a front surface side of the first light guide portion 4, a 4*c*$^{th}$ inclined surface 22*c* located on a center side of the first light guide portion 4 than the 4*b*$^{th}$ inclined surface 22*b* on the back surface side of the first light guide portion 4 and configured to reflect the light L5*b* reflected by the 4*a*$^{th}$ inclined surface 22*a* toward the front surface side of the first light guide portion 4, a 4*d*$^{th}$ inclined surface 22*d* located in the groove portion 21*b* on the front surface side of the first light guide portion 4 and configured to reflect the light L5*b* reflected by the 4*b*$^{th}$ inclined surface 22*b* toward the groove portion 23 of the first light guide portion 4, and a 4*e*$^{th}$ inclined surface 22*e* located on a front surface side of the groove portion 23 and configured to reflect the light L5*b* reflected by the 4*d*$^{th}$ inclined surface 22*d* toward the front surface side of the first light guide portion 4.

Accordingly, in the light guide body 3, it is possible to emit the lights L5*a* and L5*b* (L5) from the plurality of third emission surfaces 21*a* arranged in the upward/downward direction of the third light guide portion 6.

In addition, since a region in which the groove portion 23 and the incidence portion 7 do not overlap when seen in a front view is present in the upward/downward direction, the light L5*c*, which is some of the light L5 guided toward the third light guide portion 6, is guided toward the front surface side of the third light guide portion 6 and then emitted from the third emission surface 21*a* without being reflected by the fourth reflection portion 22 by passing through this region.

Further, while the configuration in which the groove portions 21*b* are formed is provided in the embodiment, a configuration in which the groove portions 21*b* are omitted and the entire surface of the third emitting portion 21 emits light as the third emission surface 21*a* may be provided. In addition, diffusion cuts configured to diffuse the light L5 on the fourth reflection portion 22 in the upward/downward direction may be provided, or diffusion cuts configured to diffuse the light L5 on the third emission surface 21*a* in the upward/downward direction may be provided.

In the lighting tool 1 for a vehicle of the embodiment having the above-mentioned configuration, the light L5 (L5*a*, L5*b*, L5*c*), which is main distribution from the third emission surface 21*a* of the third light guide portion 6, is emitted to the rear of the vehicle B. Accordingly, it is possible to emit red light from the third emission surface 21*a* as a main light emitting surface of the tail lamp TLL.

In addition, in the lighting tool 1 for a vehicle of the embodiment, the lights L1 and L2, which are subsidiary light distribution from the first emission surface 13*a* of the above mentioned second light guide portion 5, are emitted toward the side of the vehicle B. Accordingly, it is possible to emit red light from the first emission surface 13*a* as a subsidiary light emitting surface of the tail lamp TLL.

In the lighting tool 1 for a vehicle of the embodiment, in the above mentioned second light guide portion 5 extending so as to go around from the first light guide portion 4 toward the side of the light source 2, a proportion of the distributed light L is smaller than the third light guide portion 6 which is longer than the second light guide portion 5.

On the other hand, in the lighting tool 1 for a vehicle of the embodiment, by emitting the light L1, which is some of the light L entering from the incidence portions 7, from the side emitting portion 9 toward the second light guide portion 5, the lights L1 and L2 can be emitted from the first emission surface 13*a* (the first emitting portion 13) of the second light guide portion 5, together with the light L2 guided inside the second light guide portion 5.

Accordingly, in the lighting tool 1 for a vehicle of the embodiment, it is possible to uniformize the brightness of the lights L1 and L2 emitted from the first emission surface 13*a* of the above mentioned second light guide portion 5 and the brightness of the light L5 emitted from the third emission surface 21*a* of the third light guide portion 6, and more uniformly emit the light from the main light emitting surface and the subsidiary light emitting surface of the tail lamp TLL.

In addition, in the lighting tool 1 for a vehicle of the embodiment, the lights L3 and L4 are emitted toward the rear of the vehicle B from the second emission surface 15*a* of the first light guide portion 4 provided between the above mentioned first emission surface 13*a* and the third emission surface 21*a*. Accordingly, it is possible to prevent a dark portion (emission unevenness) from being generated between the main light emitting surface and the subsidiary light emitting surface of the tail lamp TLL.

In the lighting tool 1 for a vehicle of the embodiment, after emission from the light guide emission surface 16*a* to the air layer K, the light L3 entering the inside of the first light guide portion 4 from the light guide incidence surface 16*b* is emitted to the outside from the second emission surface 15*a*.

In this case, since the light L3 in which the brightness of which is attenuated via the air layer K than the light directly enters the second emission surface 15*a* from the incidence portion 7 is emitted from the second emission surface 15*a*, it is possible to more uniformly emit the light from between the main light emitting surface and the subsidiary light emitting surface of the tail lamp TLL while suppressing occurrence of point lighting.

As described above, in the lighting tool 1 for a vehicle of the embodiment, it is possible to more uniformly emit light from the branched light emitting surfaces of the light guide body 3.

Further, the present invention is not necessarily limited to the embodiment, and various modifications may be made without departing from the scope of the present invention.

For example, in the lighting tool 1 for a vehicle, it is possible to appropriately change a shape or the like of the light guide body 3 according to a design or the like of the actual vehicle.

In addition, when the lighting tool 1 for a vehicle is applied to the tail lamp TLL of the rear combination lamp RCL, in addition to the above mentioned light sources 2 or the light guide body 3 that is the inner lens, for example, it is possible to combine with other members such as another inner lens, reflector, extension, or the like.

Further, while the case in which the lighting tool 1 for a vehicle is applied to the tail lamp TLL of the rear combination lamp RCL has been exemplified in the embodiment, the lighting tool for a vehicle to which the present invention is applied is not limited to the lighting tool for a vehicle on the rear side, and the present invention can also be applied to a lighting tool for a vehicle on the front side.

That is, for the lighting tool for a vehicle to which the present invention is applied, in addition to the above-mentioned tail lamp, for example, the present invention can be widely applied to a lighting tool for a vehicle such as a stop lamp, a back lamp, a daytime running lamp (DRL), a width indicator (position lamp), a direction indicator (turn lamp), or the like.

In addition, for the light source, in addition to the above-mentioned LED, a light emission element such as a laser diode (LD) or the like can be used. In addition, for color of the light emitted from the light source, in addition to the above-mentioned red light, it is possible to appropriately change the color with, for example, white light, orange light, or the like, according to the purpose of the lighting tool for a vehicle.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A lighting tool for a vehicle comprising:

a light source; and a light guide body configured to guide light emitted from the light source, wherein the light guide body has:

a first light guide portion disposed in front of the light source;

a second light guide portion that is branched off from the first light guide portion and that extends so as to go around toward a side of the light source;

an incidence portion that is located on a back surface side of the first light guide portion and that is configured to cause the light emitted from the light source to enter an inside of the first light guide portion; and a side emitting portion that is located on a side of the first light guide portion facing the second light guide portion and that is configured to emit some of the light entered from the incidence portion toward the second light guide portion.

2. The lighting tool for a vehicle according to claim 1, wherein the light guide body has a protrusion that protrudes from a side of the first light guide portion facing the second light guide portion toward a side of the light source, and the side emitting portion emits light from a side surface of the first light guide portion, which includes the protrusion, facing the second light guide portion.

3. The lighting tool for a vehicle according to claim 2, wherein the side emitting portion includes a plurality of first diffusion cuts configured to diffuse light emitted from the side emitting portion.

4. The lighting tool for a vehicle according to claim 1, wherein the light guide body has:

a first reflection portion that is located on a front surface side of the first light guide portion and that is configured to reflect some of the light entering from the incidence portion toward the second light guide portion;

a plurality of first reflection cuts that are located on a back surface side of the second light guide portion and that are configured to reflect the light guided inside the second light guide portion toward a front surface side of the second light guide portion; and a first emitting portion that is located on a front surface side of the second light guide portion and that is configured to emit the light reflected by the plurality of first reflection cuts to an outside of the second light guide portion.

5. The lighting tool for a vehicle according to claim 4, wherein the first emitting portion includes a plurality of second diffusion cuts configured to diffuse the light emitted from the first emitting portion.

6. The lighting tool for a vehicle according to claim 1, wherein the light guide body has:

a second emitting portion that is located on a front surface side of the first light guide portion and that is configured to emit some of the light entered from the incidence portion to an outside of the first light guide portion; and a concave portion that is located between the incidence portion of the first light guide portion and the second emitting portion and that forms an air layer, the concave portion includes a light guide emission surface and a light guide incidence surface facing each other with the air layer being interposed therebetween in a direction of advance of the light entered from the incidence portion, and among the light entered from the incidence portion, after emission from the light guide emission surface to the air layer, the light entered an inside of the first light guide portion from the light guide incidence surface is emitted from the second emitting portion.

7. The lighting tool for a vehicle according to claim 6, wherein the second emitting portion includes a plurality of third diffusion cuts configured to diffuse the light emitted from the second emitting portion.

8. The lighting tool for a vehicle according to claim 6, wherein the light guide body has a second reflection portion configured to reflect some of the light guided inside the first light guide portion toward a bottom side of the concave portion and then reflect the light toward a front surface side of the first light guide portion.

9. The lighting tool for a vehicle according to claim 1, wherein the light guide body has:

a third light guide portion that is branched off from the first light guide portion and that extends toward a side opposite to a side where the second light guide portion is located;

a third reflection portion that is located on a front surface side of the first light guide portion and that is configured to reflect some of the light entered from the incidence portion toward the third light guide portion;

a plurality of second reflection cuts that are located on a back surface side of the third light guide portion and that are configured to reflect the light guided inside the third light guide portion toward a front surface side of the third light guide portion; and a third emitting portion that is located on a front surface side of the third light guide portion and that is configured to emit the light reflected by the plurality of second reflection cuts to an outside of the third light guide portion.

10. The lighting tool for a vehicle according to claim 9, wherein the third emitting portion has:

a plurality of emission surfaces that are extending in an extension direction of the third light guide portion on a front surface side of the third light guide portion and that are arranged in a direction crossing the extension direction of the third light guide portion; and a groove portion that is located between adjacent ones of the plurality of emission surfaces and that extends in the extension direction of the third light guide portion, and the light reflected by the plurality of second reflection cuts is emitted to an outside from the plurality of emission surfaces.

11. The lighting tool for a vehicle according to claim 10, wherein the light guide body has a fourth reflection portion configured to reflect some of the light guided toward the third light guide portion in a direction crossing the extension direction of the third light guide portion and then reflect the light toward a front surface side of the third light guide portions located on both sides with the groove portion being interposed therebetween.

12. The lighting tool for a vehicle according to claim 9, wherein the light guide body has a shape inclined or curved in a direction in which an outer side thereof is curved in a rearward direction than an inner side in the vehicle width direction in accordance with a slanted shape provided in a corner portion on a front end side or a rear end side of a vehicle, and the second light guide portion is located on an outer side in the vehicle width direction and the third light guide portion is located on the inner side in the vehicle width direction.

* * * * *